US007132024B2

(12) United States Patent
Wang et al.

(10) Patent No.: US 7,132,024 B2
(45) Date of Patent: Nov. 7, 2006

(54) ARTIFICIAL LEATHER COMPOSITE REINFORCED WITH ULTRAMICROFIBER NONWOVEN FABRIC

(75) Inventors: Ching Tang Wang, Taipei (TW); Mong-Ching Lin, Kaohsiung (TW); Chung Chih Feng, Kaohsiung (TW); Kuo Kuang Cheng, Kaohsiung (TW); Sheng Lien Chung, Pingtung (TW); Pai Hsiang Wu, Kaohsiung (TW); Chiao Fa Yang, Kaohsiung (TW); Chun Hsien Li, Kaohsiung (TW)

(73) Assignee: San Fang Chemical Industry Company, Ltd., Kaohsiung (TW)

( * ) Notice: Subject to any disclaimer, the term of this patent is extended or adjusted under 35 U.S.C. 154(b) by 278 days.

(21) Appl. No.: 10/386,290

(22) Filed: Mar. 11, 2003

(65) Prior Publication Data

US 2003/0204942 A1 Nov. 6, 2003

(30) Foreign Application Priority Data

Mar. 11, 2002 (TW) ..... 91104514 A

(51) Int. Cl.
*D04H 5/02* (2006.01)

(52) U.S. Cl. ..... 156/148; 442/105; 442/170; 442/164; 442/270; 442/275; 428/374; 428/151

(58) Field of Classification Search ..... 442/201, 442/199, 60, 105, 170, 164, 270, 275; 428/374, 428/375, 151, 160; 264/172.17, 172.11; 156/148

See application file for complete search history.

(56) References Cited

U.S. PATENT DOCUMENTS

| | | | | |
|---|---|---|---|---|
| 3,383,273 | A * | 5/1968 | Pearson et al. | 442/352 |
| 3,655,471 | A * | 4/1972 | Healy et al. | 156/148 |
| 3,692,708 | A * | 9/1972 | Meisert et al. | 521/62 |
| 3,716,614 | A * | 2/1973 | Okamoto et al. | 264/49 |
| 3,841,897 | A * | 10/1974 | Okazaki et al. | 428/151 |
| 3,865,678 | A * | 2/1975 | Okamoto et al. | 428/91 |
| 3,900,549 | A * | 8/1975 | Yamane et al. | 264/172.13 |
| 4,018,954 | A * | 4/1977 | Fukushima et al. | 428/86 |
| 4,145,468 | A | 3/1979 | Mizoguchi et al. | |
| 4,216,251 | A * | 8/1980 | Nishimura et al. | 427/370 |
| 4,342,805 | A * | 8/1982 | McCartney | 428/151 |
| 4,363,845 | A * | 12/1982 | Hartmann | 428/198 |
| 4,476,186 | A * | 10/1984 | Kato et al. | 442/60 |
| 4,966,808 | A * | 10/1990 | Kawano | 442/201 |
| 5,124,194 | A * | 6/1992 | Kawano | 442/201 |
| 5,290,626 | A * | 3/1994 | Nishioi et al. | 442/201 |
| 5,503,899 | A * | 4/1996 | Ashida et al. | 428/151 |
| 5,993,943 | A * | 11/1999 | Bodaghi et al. | 428/198 |
| 6,322,851 | B1 * | 11/2001 | Adachi et al. | 427/246 |
| 6,468,651 | B1 * | 10/2002 | Aikawa et al. | 428/364 |

FOREIGN PATENT DOCUMENTS

| | | | |
|---|---|---|---|
| EP | 1054096 | A1 * | 11/2000 |
| JP | 08-291454 | | 5/1996 |
| JP | 11-093082 | | 6/1999 |

OTHER PUBLICATIONS

Mesh Size and Micron Size: Coral Calcium Absorption. Internet Reference. URL: www.healthtreasures.com/mesh-microns.html.*

* cited by examiner

*Primary Examiner*—Richard Crispino
*Assistant Examiner*—Christopher Schatz
(74) *Attorney, Agent, or Firm*—Donald E. Hasse; Hasse & Nesbitt LLC

(57) ABSTRACT

A method for manufacturing an artificial leather comprises the following steps. First, ultramicrofiber-forming fibers having an islands-in-sea type cross-sectional configuration are formed by blend spinning or conjugate spinning. Secondly, a porous reinforcement sheet of low compactness is formed from polyester, polyurethane or polyolefin by spunbonding, meltblowing or calendering. Next, the ultramicrofibers are entangled with the reinforcement sheet by needle punching or spunlace to form the complex reinforced ultramicrofiber nonwoven fabric. The nonwoven is impregnated or coated with an elastomer resin composition, and then subjected to a coagulating process, a washing process, a drying process and a removing process to produce a semi-product leather. Finally, the semi-product leather is then processed to produce the artificial leather.

8 Claims, No Drawings

ARTIFICIAL LEATHER COMPOSITE REINFORCED WITH ULTRAMICROFIBER NONWOVEN FABRIC

BACKGROUND OF THE INVENTION

1. Field of the Invention

The present invention relates to a method for manufacturing an artificial leather, and more particularly to a method for manufacturing an artificial leather reinforced with ultramicrofiber nonwoven fabric.

2. Description of the Related Art

Typically, artificial leathers containing microfine fibers are manufactured by conjugate spinning. The microfiber made by conjugate spinning has a fineness of at most 0.015 denier; therefore, artificial leathers containing the microfibers lack suede-like touch. Artificial leathers containing microfibers manufactured by blend spinning have suede-like appearance and silky touch, but the strength of leather is quite weak. Artificial leathers manufactured by impregnating ultramicrofibers with polyurethane (PU) resin composition are well known. A method disclosed in Taiwan Patent Publication No. 152961 (Application No. 78107985), entitled "Genuine-leather-like Complex Ultramicrofiber nonwoven fabric", is shown below.

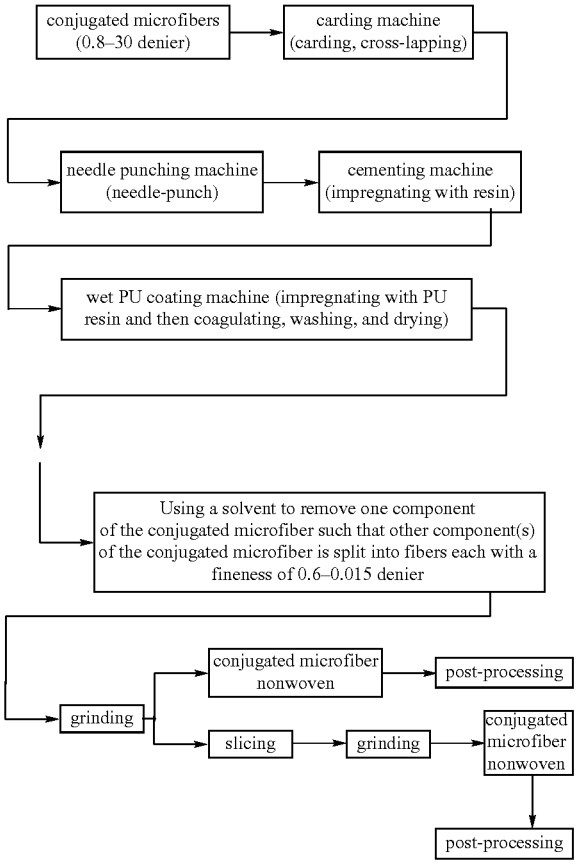

However, there is a big difference between the longitudinal elongation and the transverse elongation of the conventional microfiber nonwoven. Since the transverse elongation is much higher than the longitudinal elongation, the use of the microfiber nonwoven is limited by the orientation issue. Therefore, this nonwoven is not suitable for use in manufacturing artificial leathers.

Furthermore, microfiber nonwovens manufactured by spunlace typically have distinct traces of the waterjet and a lower peeling strength. Therefore, they are not suitable for use in manufacturing artificial leathers.

The methods of producing fibers by conjugate spinning and producing microfibers from those fibers are well known. In the conjugate spinning process, at least two compatible polymers are extruded into a fiber, and one polymer component of the resultant fiber is selectively dissolved thereby obtaining microfibers.

Besides, an artificial leather which is reinforced by a woven fabric is well known. For example, Japanese Examined Patent Publication (Kokoku) No. 4-1113 discloses a method of using a woven fabric made of high twist (above 1000 T/m) yarn as a reinforcement substrate. This technique is used to manufacture a soft artificial leather with high strength by needlepunching a staple fiber nonwoven and the reinforcement substrate into an integrated structure while minimizing damage to the reinforcement substrate by the needlepunch. The integrated structure of the staple fiber nonwoven and the reinforcement substrate are shrunk a little and impregnated with polyvinyl alcohol. Then, one part of the major fibers has a portion extracted and removed, and the product thereof is impregnated with an elastomer resin to produce artificial leather.

Also, Japanese Unexamined Patent Publication (Kokai) No. 55-57059 discloses a method of utilizing high-pressure water flow to entangle a laminate of reinforcement fabric made of shrinkable filaments with a paper nonwoven made of staple fibers (fiber length<10 mm) so as to form the artificial leather, and then shrinking the reinforcement fabric so as to increase the surface fiber density of the artificial leather.

Each of the aforementioned techniques has advantages and disadvantages. It is the purpose of the technique disclosed in the Japanese Examined Patent Publication (Kokoku) No. 4-1113 to produce a flexible substrate with a higher cutting strength by integrating the reinforcement fabric with the microfiber nonwoven. The artificial leather made from the aforementioned substrate has a higher strength while being cut, and has a significantly lower deformability due to the reinforcement fabric, as compared to other artificial leathers made from only nonwoven. However, the artificial leather still has a relatively high deformability in the range of about 10%. In the aforementioned method, though the damages occurred during needlepunch can be minimized and the artificial leather can be strengthened after the entangling step, the surface density of the entangled nonwoven is not acceptable. In order to increase the surface density, the entangled nonwoven is typically subjected to a heat shrinking treatment. However, in the technique disclosed in the aformentioned publication, since the nonwoven lacks for shrinkability, the heat treatment can only result in slight shape change which is equal to the torque release of the high twist filaments of the reinforcement fabric. Actually, if one of the nonwoven or the fabric is subjected to the heat treatment and then shrinks in order to increase the surface density of the laminate of the nonwoven and the fabric, the heat treatment will also cause the laminated artificial leather to curl, wrinkle or have an uneven surface which can cause problems in subsequent steps and degrade the quality of product. When a three-layer nonwoven/fabric/nonwoven laminated structure is adopted, the structure can be shrunk to a degree. However, the shrinking degree is too small to increase the surface density. Furthermore, PVA (polyvinyl alcohol) impregnation is disclosed in the aforementioned publication. However, when PVA impregnation is conducted, the space between fibers is filled with PVA such that the space between the fibers is enlarged thereby lowering the surface density of the artificial leather made from the fibers impregnated with PVA. Also, the artificial leather is deformed easily while being stretched.

The technique disclosed in Japanese Unexamined Patent Publication No. 55-57059 is directed to using waterjet to entangle a reinforcement fabric made of shrinkable filaments with a paper nonwoven made of staple fibers (fiber length<10 mm). However, the entanglement between the fibers of the nonwoven is quite small and the entanglement between the nonwoven and the reinforced fabric is also small. Besides, only a small amount of elastomer resin is adhered thereby contributing little anti-deformability to the nonwoven when the artificial leather is deformed. Furthermore, the products of this method have a disadvantage that the fibers are prone to drop from the artificial leather.

In another method, after a nonwoven is entangled, a reinforcement fabric is attached onto the backside surface of the entangled nonwoven. When a shrinkable nonwoven is used, the artificial leather with a higher surface density can be obtained. However, since the bonding strength between the nonwoven and the reinforcement fabric is quite weak, delamination is observed during subsequent processing steps. Furthermore, this method needs an attaching step thereby increasing the manufacturing cost.

In order to manufacture artificial leathers with a high anti-deformability (i.e., a smaller difference between the longitudinal elongation and the transverse elongation thereof), the bonding of the nonwoven to the reinforcement fabric is preferably conducted by laminating the nonwoven having a low degree of entanglement on the reinforcement fabric. Preferably, the nonwoven and the reinforcement fabric are firmly entangled in a mechanical way by spunlace or needlepunch. Thus, by laminating with the entangled reinforcement fabric (especially adequate selection of the reinforcement fabric), the finished artificial leather can be endowed with anti-deformability and the shape change (especially the elongation due to the tensile force in the manufacturing process) of the artificial leather occurred in most of the manufacturing steps can be minimized. In the process of manufacturing a suede-like artificial leather, the surface fiber density is the most important factor to determine the grade of the product.

The surface density of the complex artificial leather can be increased by two important ways including (1) shrinking the nonwoven to increase the surface density; and (2) minimizing the elongation due to the tensile force in the manufacturing process. However, as mentioned above, high-surface-density artificial leather with minimized shape change (especially the elongation due to the tensile force in the manufacturing process) cannot be obtained by current methods.

DETAILED DESCRIPTION OF THE PREFERRED EMBODIMENT

For the problems mentioned above, the inventors of the present invention have researched and improved the manufacturing process thereby developing a complex ultramicrofiber nonwoven fabric made by adding reinforcement material to a ultramicrofiber nonwoven fabric. This complex ultramicrofiber nonwoven fabric can be used as a substrate to manufacture a light-weight, high strength and high performance artificial leather. The artificial leather with a reinforced ultramicrofiber nonwoven fabric as substrate not only reduces the problem for the difference between the longitudinal elongation and the transverse elongation, but also has better softness and physical strength than a microfiber artificial leather. Besides, a light-weight high-strength ultramicrofiber nonwoven fabric impregnated with a elastomer resin composition can be utilized to manufacture a ultramicrofiber artificial leather thereby reducing the weight thereof. The elastomer resin composition used in the manufacturing process can be added with various desired dye in order to offer more choices in color.

It is an object of the invention to provide artificial leathers reinforced with ultramicrofiber nonwoven fabric and a manufacturing method therefor. The obtained artificial leather has features of light-weight and high physical strength, and the longitudinal and transverse elongation thereof are adjustable. The method has advantages of simplification and variety.

The method according to the present invention for manufacturing artificial leather reinforced with ultramicrofiber nonwoven fabric mainly includes the following steps. First, ultramicrofibers having an islands-in-sea type cross-sectional configuration are formed by blend spinning or conjugate spinning, and used as a major material of the nonwoven. Next, a porous reinforcement sheet of low compactness is formed from polyester, polyurethane or polyolefin by spunbonding, meltblowing or calendering. Alternatively, twisted yarn may be used to form the reinforcement sheet by a weaving or knitting machine. The ultramicrofibers are entangled with the reinforcement sheet by needle punching or spunlace to form the complex reinforced ultramicrofiber nonwoven fabric. The complex reinforced ultramicrofiber nonwoven fabric is impregnated or coated with an elastomer resin composition, and then subjected to a coagulating process, a washing process, a drying process and a removing process to produce a semi-product leather. The semi-product leather is then treated with a release paper transferring process, a laminating process or an embossing process to produce an artificial leather with the textures of a genuine leather. Alternatively, the semi-product leather may be treated with a grinding process and a dying process to produce a suede-like artificial leather.

In the method according to the present invention for manufacturing an artificial leather reinforced with ultramicrofiber nonwoven fabric, ultramicrofiber-forming fibers having an islands-in-sea type cross-sectional configuration are used as a major materials of the nonwoven. The ultramicrofibers are formed from polyamide polymer (such as nylon 6, nylon 66 or other nylon polymer), polyester polymer (such as polyethylene terephthalate, polypropylene terephthalate, polybutylene terephthalate), polyolefin polymer (such as polystyrene, polyethylene, polypropylene, polymethylpentene), thermoplastic polyvinyl alcohol, water soluble copolyester, or thermoplastic polyurethane by blend spinning and conjugate spinning. The ultramicrofiber is an islands-in-sea type ultramicrofiber-forming fiber with a fineness within the range of 1–10 denier. When the sea component of the ultramicrofiber-forming fiber is dissolved, the remaining island component bundles can be separated from one another to form ultramicrofibers with a fineness within the range of 0.1–0.0001 denier.

The porous reinforcement sheet of low compactness is formed from polyester, polyurethane or polyolefin by spunbonding, meltblowing or calendering. Alternatively, twisted yarn (1100~1000 T/m) may be used to form the reinforcement sheet by a weaving or knitting machine. The reinforcement sheet has a thickness of 0.01–1.0 mm, a weight per unit area of 10–200 g/m$^2$ and a mesh size of 10–150 mesh. The reinforcement sheet is incorporated during the needlepunch or spunlace process in a manner that the ultramicrofibers are entangled with the reinforcement sheet by needlepunch or spunlace thereby forming a ultramicrofiber nonwoven fabric.

The reinforced ultramicrofiber nonwoven fabric is impregnated with an elastomer resin composition which may include solvent-soluble elastomer resin or water-soluble elastomer resin. The elastomer resin composition can be added with dye according to the desired color. For example, a substrate is impregnated with a solvent soluble elastomer composition until the impregnated elastomer weighs 0.5–3 times as much as the substrate. Thereafter, the substrate is coagulated in a 5 %–50% DMF bath, washed by water with a temperature of 70 to 100 to conduct exchange between DMF and water, and then dried under a temperature of 100–160 so as to form a flexible hard leather substrate. The leather substrate is subjected to a removing process to produce a semi-finished leather. The semi-finished leather is treated with a release paper transferring process to produce an artificial leather with the textures of a genuine leather. The semi-finished leather may also be treated with a grinding process and a dying process to produce a suede-like artificial leather. Alternatively, the impregnated ultramicrofiber nonwoven fabric can also be coated with a PU resin composition directly to reduce the manufacturing steps. The ultramicrofiber nonwoven fabric coated with PU can further be subjected to a removing process to form the semi-product leather. The semi-product leather can be treated with a laminating process, an embossing process or a grinding process to produce a variety of artificial leathers. The semi-product leather may be treated with a release paper transferring process to produce artificial leathers wherein the release paper is coated with a one-component polyurethane composition as a surface layer, and a two-component polyurethane composition as an adhesive layer.

An ultramicrofiber nonwoven suitable for use in the present invention is the ultramicrofiber substrate disclosed in the Taiwan Patent Application No. 90133071 entitled "Method for Manufacturing Ultramicrofiber Substrate." There are two kinds of polymers used in that invention: one polymer is soluble in solvent or hot water, and the other polymer is only slightly soluble or even insoluble in solvent or hot water. The two kinds of polymers mixed by a certain weight or volume ratio and another solvent insoluble or hot-water insoluble polymer are pushed through a spinneret having fan-shaped arrangement of segments to form micro fibers with different fineness by conjugate spinning. The solvent soluble polymer is polystyrene, polyethylene or thermoplastic polyurethane. The water soluble polymer is thermoplastic polyvinyl alcohol or water soluble copolyester, wherein the water soluble copolyester is a copolymer including isophthalic acid, terephthalic acid, acrylate acid, sulfoisophthalate sodium salt, or polyethylene glycol. The thermoplastic polyvinyl alcohol is produced by hydrolysis of 70% to 100%, preferably 75% to 95%, of polyvinyl acetate in water. The polyvinyl alcohol may include plasticizer additives or other water soluble polymer like polyvinylpyrrolidone, polyethylquizalofop, or polyepoxyethane.

The solvent insoluble or hot-water insoluble polymer can be polyester polymer, polyamide polymer, or polyolefin polymer. The aforementioned polyester polymer is polyethylene terephthalate, polypropylene terephthalate or polybutylene terephthalate; the polyamide polymer is nylon 4, nylon 6, nylon 66, nylon 610 or nylon 11; water insoluble polyolefin polymer is polyethylene, polypropylene, polystyrene, polyvinyl acetate, polybutylene or the copolymer thereof.

The removing process of the present invention is accomplished by using solvent like alkaline solution, tetrachloroethylene, toluene, or N,N-dimethyl formamide, or water to remove the solvent soluble or water soluble polymer (such as polyamide polymers, polyester polymers or polypropylene) from the ultramicrofibers obtained in the aforementioned spinning step. The remaining ultramicrofibers can have a fineness of 0.1–0.0001 denier. The ultramicrofibers can be further treated with a grinding process so as to have a fine nap touch on the surface thereof. Generally speaking, products formed from the ultramicrofibers have poor physical characteristics (such as peeling strength, tensile strength, or tearing strength), because they only have fine short nap on the surface thereof. However, the nap of the present invention has not only short nap but also long nap. The long nap can overcome the disadvantage of poor physical characteristics of common ultramicrofiber products.

In the present invention, the ultramicrofibers are entangled with a reinforcement sheet by needlepunch or spunlace to form a complex reinforced ultramicrofiber nonwoven fabric. The porous reinforcement sheet of low compactness is formed from polyester, polyurethane or polyolefin by spunbonding, meltblowing or calendering. Alternatively, twisted yarn may be used to form the reinforcement sheet by a weaving or knitting machine. The ultramicrofibers can be entangled with the reinforcement sheet by any effective entangling treatment, like high-pressure spunlace treatment or needlepunch treatment, wherein the needlepunch treatment capable of achieving high entanglement is preferred.

The aforementioned complex reinforced ultramicrofiber nonwoven fabric is impregnated or coated with an elastomer resin composition, and then subjected to a coagulating process, a washing process, a drying process and a removing process to produce a semi-product leather. The semi-product leather is then treated with a release paper transferring process, a laminating process or an embossing process to produce an artificial leather with the textures of a genuine leather. Alternatively, the semi-product leather may be treated with a grinding process and a dying process to produce a suede-like artificial leather. The artificial leather obtained by the aforementioned methods can solve the problem due to the difference between the longitudinal elongation and the transverse elongation.

The impregnating or coating elastomer resin composition of the complex reinforced ultramicrofiber nonwoven fabric may be rubbery elastomer, such as polyurethane, SBR, NBR, polyamino acid or acrylates, wherein the polyurethane is preferable in consideration of the hand feel of the obtained artificial leather and the physical characteristics thereof. Elastomer resin compositions which are in solution form and capable of use in wet coagulation are preferable, although the hand feel of the product thereof is slightly bad. The hydrophilic emulsion of polyurethane or acrylate can also be used alone or together. The impregnated amount of the rubbery elastomer resin composition is preferably weight 10–25% of the weight of the fibers which constitute the artificial leather. Next, the surface of the ultramicrofiber nonwoven fabric side of the artificial leather is buffed with a sand paper so as to form a napping surface and then dyed so as to form a suede-like artificial leather. Alternatively, the napping treatment can be substituted by a resin coating treatment, and then an embossing treatment or a flattening treatment is conducted so as to produce an artificial leather with embossment similar to genuine leather and a shiny surface. A dying treatment or other treatments can also be conducted if desired.

In the present invention, the ultramicrofibers are formed by blend spinning or conjugate spinning, and a porous reinforcement sheet of low compactness is formed from polyester, polyurethane or polyolefin by spunbonding, melt-blowing or calendering. Alternatively, processed yam may be used to form the reinforcement sheet by a weaving or knitting machine. The ultramicrofibers are entangled with the reinforcement sheet by needle punching or spunlace to form the complex reinforced ultramicrofiber nonwoven fabric. The complex reinforced ultramicrofiber nonwoven fabric is impregnated or coated with an elastomer resin composition, and then subjected to a coagulating process, a washing process, a drying process and a removing process to produce a semi-product leather. The semi-product leather is then treated with a release paper transferring process, a laminating process or an embossing process to produce an artificial leather with the textures of a genuine leather. Alternatively, the semi-product leather may be treated with a grinding process and a dying process to produce a suede-like artificial leather. The artificial leather obtained by the aforementioned methods can solve the problem due to the difference between the longitudinal elongation and the transverse elongation.

The method for manufacturing an artificial leather reinforced with ultramicrofiber nonwoven fabric of the present invention is outlined into the flowchart below according to the aforementioned reinforcing process. One embodiment of for manufacturing an artificial leather reinforced with ultramicrofiber nonwoven fabric of the present invention is illustrated as follows:

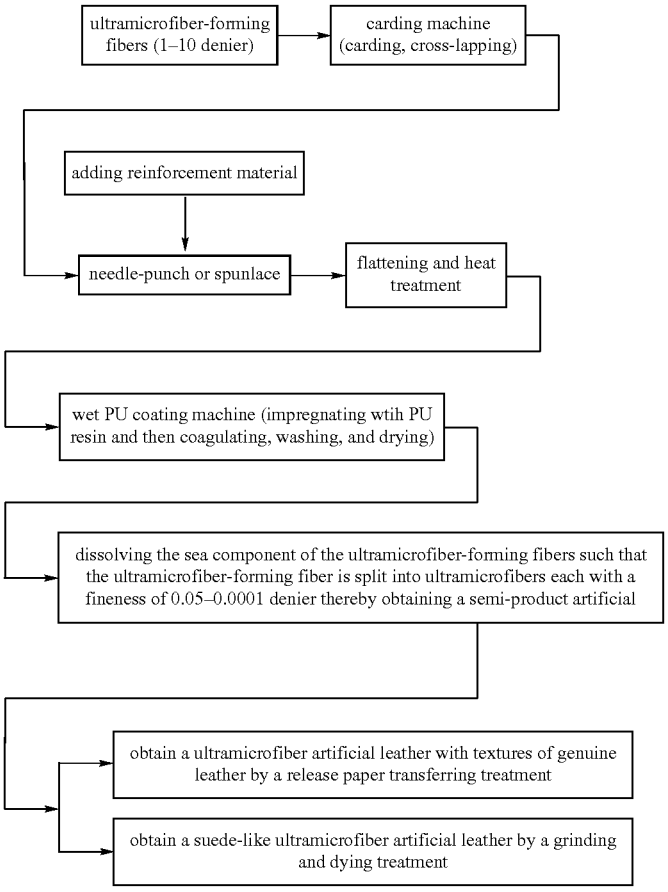

Another embodiment of the method for manufacturing an artificial leather reinforced with ultramicrofiber nonwoven fabric of the present invention is illustrated as follows:

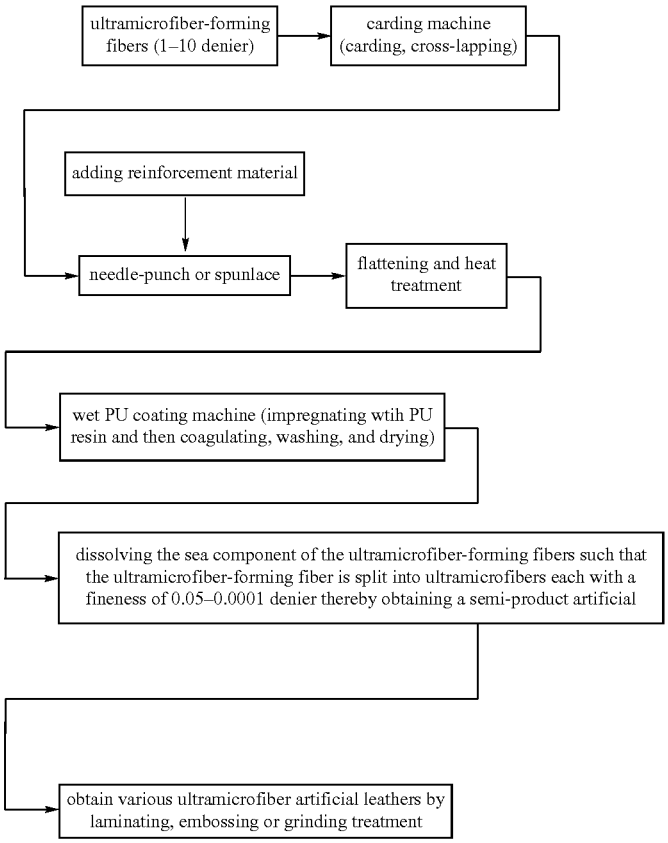

EXAMPLES

The invention is more particularly described by the following examples, which should not be construed to limit the invention thereto.

Example 1

50 parts of Polyamide 6 (used as an island component) and 50 parts of polystyrene (used as a sea component) are conjugate spun into fibers through a spinneret at a temperature of about 280° C. The fibers are wound up at a speed of about 900 m/min so as to produce an undrawn yarn. The undrawn yarn is drawn at a temperature of about 80° C., and then dry and cut to produce islands-in-sea type superfine staple fiber which has a fiber fineness of 4 dpf and a fiber length of 51 mm.

The islands-in-sea type superfine staple fibers are combed into a uniform web by a carding machine. The webs are then cross-lapped into a web laminate by a cross-lapping machine. The web laminate is then entangled with a reinforcement sheet by needlepunch (the needling density is 700 needle/$m^2$) to produce a complex reinforced ultramicrofiber nonwoven fabric of 340 g/$m^2$. The reinforcement sheet has a thickness of about 0.1 mm, has a weight per unit area of about 40 g/$m^2$ and is formed from twisted yarn (500 T/m) by a weaving machine.

The reinforced ultramicrofiber nonwoven fabric is then impregnated with a solution prepared by 40 parts of PU composition and 60 parts of dimethylformamide (DMF). After the impregnated PU composition weighs 1.8 times as much as the nonwoven, the substrate is added with red dye and then coagulated in a 25% DMF bath under a temperature of 25° C. to conduct exchange between DMF and water. The substrate is then washed by 100° C. water, and baked under 125° C. so as to form a flexible hard leather substrate which is subjected to a removing process to produce a semi-finished leather. A release paper is coated with a one-component polyurethane composition as a surface layer, and a two-component polyurethane composition as an adhesive layer. The semi-finished leather is subjected to a release paper transferring process, a curing process and a treatment of the releasing surface to obtain artificial leather with textures of a genuine leather.

The test results of the ultramicrofiber artificial leather obtained in Example 1 and conventional ultramicrofiber artificial leathers are listed below:

| | Ultramicrofiber artificial leather obtained in Example 1 | Conventional microfiber artificial leather | Test method |
|---|---|---|---|
| Thickness | 1.10 mm | 1.10 mm | ASTM D-1777 |
| Weight per unit area | 330 g/$m^2$ | 430 g/$m^2$ | ASTM D-751 |

-continued

| | Ultramicrofiber artificial leather obtained in Example 1 | Conventional microfiber artificial leather | Test method |
|---|---|---|---|
| Elongation (longitudinal) | 79% | 68% | ASTM D-1682 |
| Elongation (transverse) | 87% | 119% | ASTM D-1682 |
| Tensile Strength (longitudinal) | 10.1 kgf | 9.8 kgf | ASTM D-1682 |
| Tensile Strength (transverse) | 13.5 kgf | 12.5 kgf | ASTM D-1682 |
| Bursting strength | 31.3 kgf/cm$^2$ | 29.6 kgf/cm$^2$ | ASTM D-751 |
| Peeling strength (transverse) | At least 32 N/cm | 25 N/cm | DIN 53273 |

Example 2

The complex reinforced ultramicrofiber nonwoven fabric of 340 g/m$^2$ obtained in Example 1 is impregnated with a solution prepared by 40 parts of PU composition and 60 parts of dimethylformamide (DMF). After the impregnated PU composition weighs 1.8 times as much as the nonwoven, the substrate is added with red dye and then coagulated in a 25% DMF bath under a temperature of 25° C. to conduct exchange between DMF and water. The substrate is then washed by 100° C. water, and baked under 125° C. so as to form a flexible hard leather substrate which is subjected to a removing process to produce a semi-finished leather. The semi-finished leather is subjected to a grinding process and a dying process to obtain a suede-like artificial leather.

Example 3

The complex reinforced ultramicrofiber nonwoven fabric of 340 g/m$^2$ obtained in Example 1 is impregnated with a solution prepared by 40 parts of PU composition and 60 parts of dimethylformamide (DMF). After the impregnated PU composition weighs 1.8 times as much as the nonwoven, the substrate is added with red dye and then coagulated in a 25% DMF bath under a temperature of 25° C. to conduct exchange between DMF and water. The substrate is then washed by 100° C. water, and baked under 125° C. so as to form a flexible hard leather substrate which is subjected to a removing process to produce a semi-finished leather. The semi-finished leather is subjected to an embossing process to produce a artificial leather with the textures of a genuine leather.

According to the disclosure of Taiwan Patent Publication No. 152961 (Application No. 78107985) entitled "Genuine-leather-like Complex Micro fiber Nonwoven", the fineness of the fiber obtained after the removing process is 0.6–0.015 denier. In the present invention, the fiber fineness of the ultramicrofiber semi-product leather obtained after the removing process is 0.05–0.0001 denier and the finished artificial leather has characteristics of light-weight, high softness, and high physical strength. The test results are listed below:

| | Ultramicrofiber Semi-Product Product Of The Present Invention | Taiwan Patent Application No. 78107985 | Test method |
|---|---|---|---|
| Thickness | 1.0 mm | 1.0 mm | CNS1274 |
| Weight Per Unit Area | 250 g/m$^2$ | 300 g/m$^2$ | ASTM D-751 |
| Tearing Strength (longitudinal) | 7.1 kgf | 5.8 kgf | CNS1279 |
| Tearing Strength (transverse) | 6.7 kgf | 5.8 kgf | |
| Tensile Strength (longitudinal) | 42 kgf | 38 kgf | CNS1278 |
| Tensile Strength (transverse) | 44 kgf | 36 kgf | |

Compared with the same kind of conventional products under the same standards, the ultramicrofiber artificial leather produced by the method of the present invention has similar appearance and touch. Furthermore, the artificial leathers of the present invention have features of light-weight and high physical strength, and the longitudinal and transverse elongation thereof are similar. The method of the present invention has advantages of simplification and variety and the artificial leathers made by the method are suitable for manufacturing gloves, clothes, shoes, chair covers, leather bags, sofas, balls and the like.

What is claimed is:

1. A method for manufacturing an artificial leather, comprising the steps of:

forming ultramicrofibers having an islands-in-sea type cross-sectional configuration by blend spinning or conjugate spinning;

forming a porous reinforcement sheet of low compactness from at least one material selected from the group consisting of polyester, polyurethane and polyolefin by spunbonding, meltblowing or calendering, or from twisted yarn (100~1000T/m) by a weaving or knitting machine, wherein the reinforcement sheet has a thickness of 0.01–1.0 mm, a weight per unit area of 10–200 g/m$^2$ and a mesh size of 10–150 mesh;

using needlepunch or spunlace to entangle the ultramicrofibers with the reinforcement sheet thereby forming a complex reinforced ultramicrofiber nonwoven fabric;

impregnating or coating the nonwoven with an elastomer resin composition;

subjecting the nonwoven fabric to a coagulating process, a washing process, a drying process and a removing process to produce a semi-product leather; and processing the semi-product leather to produce the artificial leather with the textures of a genuine leather.

2. The method as claimed in claim 1, wherein the ultramicrofiber-forming fiber has a fineness of about 1 to about 10 denier.

3. The method as claimed in claim 1, wherein the island component of the ultramicrofiber-forming fiber has a fineness of about 0.05 to about 0.0001 denier.

4. The method as claimed in claim 1, wherein the processing steps comprise the steps of:

coating an one-component polyurethane composition on a release paper to form a surface layer;

coating a two-component polyurethane composition on the surface layer to form an adhesive layer; and attaching the surface layer to the semi-finished leather thereby obtaining the artificial leather.

5. The method as claimed in claim 1, wherein the processing steps comprise the steps of forming a napped surface by buffing the semi-product leather with a sand paper and dying the semi-product leather so as to produce a suede-like artificial leather.

6. A method for manufacturing an artificial leather, comprising the steps of:

forming ultramicrofibers having an islands-in-sea type cross-sectional configuration by blend spinning or conjugate spinning;

forming a porous reinforcement sheet of low compactness from at least one material selected from the group consisting of polyester, polyurethane and polyolefin by spunbonding, meltblowing or calendering, or from processed yarn by a weaving or knitting machine; wherein the reinforcement sheet has a thickness of about 0.1 to 1.0 mm, a weight per unit area of about 10 to 200 g/m$^2$ and a mesh size of about 10 to 150 mesh;

using needlepunch or spunlace to entangle the ultramicrofibers with the reinforcement sheet thereby forming a complex reinforced ultramicrofiber nonwoven fabric;

impregnating the nonwoven and directly coating an elastomer resin composition on the nonwoven to produce a semi-product leather; and subjecting the semi-product leather to a laminating process, an embossing process or a grinding process thereby obtaining the artificial leather.

7. The method as claimed in claim 6, wherein the ultramicrofiber has a fineness of about 1 to about 10 denier.

8. The method as claimed in claim 6, wherein the island component of the ultramicrofiber has a fineness of about 0.05 to about 0.0001 denier.

* * * * *